US006539356B1

(12) United States Patent
Matsui et al.

(10) Patent No.: US 6,539,356 B1
(45) Date of Patent: Mar. 25, 2003

(54) SIGNAL ENCODING AND DECODING METHOD WITH ELECTRONIC WATERMARKING

(75) Inventors: Kineo Matsui, Yokosuka (JP); Munetoshi Iwakiri, Yokosuka (JP)

(73) Assignee: Kowa Co., Ltd., Nagoya (JP)

( * ) Notice: Subject to any disclaimer, the term of this patent is extended or adjusted under 35 U.S.C. 154(b) by 0 days.

(21) Appl. No.: 09/600,095

(22) PCT Filed: Jan. 30, 1998

(86) PCT No.: PCT/JP98/00418

§ 371 (c)(1),
(2), (4) Date: Sep. 8, 2000

(87) PCT Pub. No.: WO99/37028

PCT Pub. Date: Jul. 22, 1999

(30) Foreign Application Priority Data

Jan. 13, 1998 (JP) ..... 10-005150

(51) Int. Cl.[7] ..... G10L 21/04; G10L 19/14; G10L 19/02; G10L 19/12

(52) U.S. Cl. ..... 704/270; 704/201; 704/230; 704/204; 704/222

(58) Field of Search ..... 704/220, 219, 704/203, 273, 503, 504, 201, 230, 222, 204; 341/51; 369/106, 275.3

(56) References Cited

U.S. PATENT DOCUMENTS 5,839,098 A * 11/1998 Laroia et al. ..... 704/220
6,140,947 A * 10/2000 Livingston ..... 341/106
6,320,829 B1 * 11/2001 Matsumoto et al. ..... 369/275.3
6,359,573 B1 * 3/2002 Taruguchi et al. ..... 341/51

FOREIGN PATENT DOCUMENTS

JP 59-12499 A 1/1984
JP 8-241403 A 9/1996
JP 9-134125 A 5/1997
JP 10-224342 * 8/1998 ..... H04L/9/18
JP 10-303-755 * 11/1998 ..... G10L/9/18
JP 10-313402 * 11/1998 ..... G06T/1/00
JP WO 0044163 A1 * 1/1999 ..... G06T/1/00

OTHER PUBLICATIONS

Recommendation G.728, "Coding of Speech at 16kbit/s Using Low–Delay Code Excited Linear Prediction", *The International Telegraph and Telephone Consultative Committee*, Geneva, Switzerland, 1992, pp. 1–7.

Ozawa, Kazunori, "High Efficiency Voice Encoding Technique for Digital Mobile Communication", Kabushiki Kaisha Trikeps, 1992, pp. 51–56 & 104–106.

Yasuda, Hiroshi, "International Standard of Multimedia Encoding", Maruzen Co., Ltd., 1991, pp. 179–190.

* cited by examiner

*Primary Examiner*—Doris H. To
*Assistant Examiner*—Daniel A Nolan
(74) *Attorney, Agent, or Firm*—Davis & Bujold, P.L.L.C.

(57) ABSTRACT

An encoder which encodes a voice in accordance with LD-CELP (Low-Delay Code Excited Linear Prediction) of the ITU-T Recommendation G.728. When a vibration wave is encoded by vector quantization, the code is secretly combined with other data. The encoder stores dividing key data $k_{idx}$ by which 128 types of representative vector data (waveform codes) yj; j=0, 1, . . . , 127 are labeled with 0 or 1 in order from the uppermost bit. If the bit is "0", the vectors are quantized by using only the waveform codes yj corresponding to the bit "0" of the dividing key data $k_{idx}$ as the selection objects. If the bit is "1", the vectors are quantized by using only the waveform codes yj corresponding to the bit "1" of the dividing key data $k_{idx}$ as the selection objects. Thus, the outputted voice code is combined with another datum bit.

8 Claims, 10 Drawing Sheets

SIGNAL ENCODING AND DECODING METHOD WITH ELECTRONIC WATERMARKING

FIELD OF THE INVENTION

The present invention relates to an encoding method for combining and encoding a vibration wave such as a voice signal with other data such as text data indicating a document and authentication data indicating a transmitter and a decoding method.

BACKGROUND OF THE INVENTION

As a conventional encoding technique for transmitting or accumulating a voice as one of vibration waves, there is a technique which uses vector quantization (VQ) for regarding N sample values of a voice waveform as an N-dimensional vector, and encoding the vector (specifically, vector data consisting of N sample values, further the vector data indicating the waveform for a predetermined time in the voice waveform) into one code.

Moreover, in the encoding system using the vector quantization, voice is encoded in a procedure of: successively inputting the above-described vector data; selecting the representative vector data most approximate to the currently inputted vector data from a codebook for storing a plurality of representative vector data successively numbered beforehand every time the vector data is inputted; and outputting binary data indicating the number of the selected representative vector data as the code indicating the currently inputted vector data.

Moreover, to reproduce the voice, by successively inputting the encoded code, extracting the representative vector data of the number indicated by the code from the same codebook as the codebook used during encoding every time the code is inputted, and reproducing the waveform corresponding to the currently inputted code from the extracted representative vector data, the voice waveform is restored.

Moreover, as the representative encoding system using this vector quantization, code excited linear prediction (CELP) encoding, and 16 kbit/s low delay code excited linear prediction encoding (LD-CELP: Low Delay-CELP) of the International Telecommunication Union (ITU)-T Recommendation G.728, and the like are exemplified.

Additionally, the above-described LD-CELP uses CELP as a principle, and is known as a method with little encoding delay regardless of a low bit rate. Moreover, CELP or LD-CELP is described in detail, for example, in document 1 "Recommendation G.728, ITU (1982)", document 2 "High Efficiency Voice Encoding Technique for Digital Mobile Communication, authored by Kazunori OZAWA,. Kabushiki Kaisha Trikeps (1992)", document 3 "International Standard of Multimedia Encoding, authored by Hiroshi YASUDA, Maruzen Co., Ltd. (1991)", and the like.

Additionally, since the digital code of the voice encoded by this encoding system (voice code) can easily be duplicated, there is a fear of secondary use without any permission. Therefore, there is a problem that it is difficult to protect digitized works.

In recent years, as a countermeasure of the problem, the application of electronic watermark has been studied. Specifically, other data such as the authentication data indicating the caller is secretly combined and embedded in the voice code.

However, a preferred method by which other data can secretly be combined (embedded) with the voice code encoded by the above-described vector quantization has not been considered. Moreover, if the other data is simply combined, there is a high possibility that the other combined data is easily deciphered by the third party.

Therefore, when the vibration wave other than a voice signal, such as an analog signal outputted from a sensor, a measuring instrument or the like is encoded by the vector quantization, the electronic watermarking for combining the code with other data such as the authentication data indicating a utilizer and the text data indicating document cannot be performed.

The present invention has been developed in consideration of the problem, and an object thereof is to provide a method of encoding a vibration wave which can secretly be combined with another data during the encoding of a vibration wave such as a voice signal by vector quantization, and a method of decoding the vibration wave in which another data can securely be extracted from the code generated by the encoding method.

SUMMARY OF THE INVENTION

In a vibration wave encoding method of the present invention which has been developed to achieve the above-described object, every time the vector data indicating a waveform of a vibration wave for a predetermined time is inputted, the representative vector data most approximate to the currently inputted vector data is selected from a codebook for storing a plurality of representative vector data successively numbered beforehand, and binary data indicating the number of the selected representative vector data is outputted as the code indicating the currently inputted vector data.

Specifically, the vibration wave is encoded by the vector quantization represented by the above-described CELP or LD-CELP, but during the encoding, the information of the vibration wave is combined with other information by embedding the data constituting the other information in the code to be outputted by the following procedure.

First, division instruction information indicating that each representative vector data stored in the codebook belongs to either a first group or a second group is pre-stored in predetermined memory means.

Subsequently, by reading another binary data to be combined with the vibration wave before selecting the representative vector data most approximate to the currently inputted vector data, selecting the representative vector data most approximate to the currently inputted vector data only from the representative vector data belonging to the first group as indicated by the division instruction information stored in the memory means in the representative vector data stored in the codebook when the read binary data is "0", or selecting the representative vector data most approximate to the currently inputted vector data only from the representative vector data belonging to the second group as indicated by the division instruction information stored in the memory means in the representative vector data stored in the codebook when the read binary data is "1" the code indicating the currently inputted vector data is combined with the read binary data.

Therefore, when the read binary data is "0" the outputted code is binary data indicating any number of the representative vector data belonging to the first group, and conversely when the read binary data is "1" the outputted code is binary data indicating any number of the representative vector data belonging to the second group.

Specifically, in the vibration wave encoding method of the present invention, by switching the selection range of the representative vector data in the codebook to the first group and the second group determined by the division instruction information in accordance with the other binary data to be combined, the binary data of the other information is combined (embedded) in the code indicating the inputted vector data.

On the other hand, the vibration wave is restored and the binary data combined as described above can be separated from the code generated by the encoding method by the decoding method of the present invention.

First, in the decoding method of the present invention, every time the code generated by the above-described encoding method is successively inputted, by extracting the representative vector data of the number indicated by the code from the same codebook as the codebook, and reproducing the waveform corresponding to the currently inputted code from the extracted representative vector data, the vibration wave is restored. Specifically, the vibration wave is reproduced by the decoding procedure of the encoding system using the vector quantization.

Here, the division instruction information is stored in predetermined memory means.

Moreover, to perform the decoding as described above, by determining that the code is combined with the binary data "0" when the number indicated by the currently inputted code is the number of the representative vector data belonging to the first group as indicated by the division instruction information stored in the memory means in the representative vector data stored in the codebook, and determining that the code is combined with the binary data "1" when the number indicated by the currently inputted code is the number of the representative vector data belonging to the second group as indicated by the division instruction information stored in the memory means in the representative vector data stored in the codebook, the other binary data is separated from the currently inputted code.

Therefore, according to the decoding method, the vibration wave is reproduced and the other data can securely be extracted from the code generated by the encoding method.

Moreover, by the encoding method and the decoding method, only a person who knows the division instruction information for dividing the representative vector data in the codebook into two groups can extract the other binary data from the encoded code. Therefore, when the vibration wave is encoded, it is possible to secretly combine the other data and secretly extract the combined data.

Furthermore, by setting the division instruction information so that the numbers of the representative vector data belonging to the first group and the numbers of the representative vector data belonging to the second group are dispersed at random, for example, even if all the codes are combined with the binary data "0", the numbers indicated by the encoded codes fail to deviate, and a possibility that the third party notices the embedding of the other data can remarkably be lowered.

Additionally, according to the encoding method there is a great advantage that a special processing is unnecessary during regeneration of the vibration wave.

Moreover, in the encoding method, when the same division instruction information is used for a long time, some characteristics appear in each encoded code bit value, and the third party possibly notices that the other data is combined.

Therefore, according to the vibration, wave encoding method, in the encoding method, with respect to the previously outputted code, a change condition determination processing of determining whether or not a bit series of the code has a predetermined arrangement pattern is performed before selecting the representative vector data most approximate to the currently inputted vector data. When an affirmative determination is made by the change condition determination processing (specifically, when it is determined that the bit series of the previously outputted code has the predetermined arrangement pattern), the division instruction information to be stored in the memory means is changed in accordance with a predetermined change rule.

In other words, when the bit series of the currently outputted code has the predetermined arrangement pattern, the division instruction information for use in combining the next outputted code with another binary data is changed in accordance with the predetermined change rule.

For this purpose, according to the encoding method, every time the bit series of the outputted code obtains the predetermined arrangement pattern, the selection range (the first and second groups) of the representative vector data in accordance with the binary data to be combined is changed, and some characteristics can be prevented from appearing in the respective encoded code bit values. Therefore, the possibility that the third party notices the combining of the other data can be reduced.

On the other hand, by the decoding method, the vibration wave is restored and the binary data combined as described above can be separated from the code generated by the encoding method.

First, in one embodiment, the vibration wave is reproduced, and the processing of separating the other binary data from the inputted code is performed (i.e., a separation processing in which when the number indicated by the currently inputted code is the number of the representative vector data belonging to the first, group as indicated by the division instruction information stored in the memory means in the representative vector data stored in the codebook, it is determined that the code is combined with the binary data "0", or when the number indicated by the currently inputted code is the number of the representative vector data belonging to the second group as indicated by the division instruction information stored in the memory means in the representative vector data stored in the codebook, it is determined that the-code is combined with the binary data "1", and other binary data is separated from the currently inputted code).

Moreover, particularly in the decoding method, before the separation processing is performed with respect to the currently inputted code, the same change condition determination processing as the change condition determination processing is performed on the previously inputted code. When the affirmative determination is made by the change condition determination processing (specifically, when it is determined that the bit series of the previously inputted code has the predetermined arrangement pattern), a change processing is performed by changing the division instruction information to be stored in the memory means in accordance with the same change rule.

According to the decoding method, the division instruction information can be changed similarly to the encoding method, and as a result, the other binary data can securely be extracted from the code generated by the encoding method.

Additionally, considering a possibility that the combined data is deciphered by the third party, when the other binary data is embedded in all the codes, there is a disadvantageous respect.

Therefore, in one embodiment, the vibration wave is encoded by the vector quantization, but during the encoding, the outputted code is combined with another data by the following procedure.

First, similarly to the encoding method, the division instruction information indicating that each representative vector data stored in the codebook belongs to the first group or the second group is pre-stored in the predetermined memory means.

Moreover, particularly before the representative vector data most approximate to the currently inputted vector data is selected, with respect to the previously outputted code, a synthesis condition determination processing is performed in which it is determined whether or not the bit series of the code has the predetermined arrangement pattern.

Furthermore, similarly to the encoding method, by reading the other binary data to be combined with the vibration wave only when the affirmative determination is made by the synthesis condition determination processing (specifically, when it is determined that the bit series of the previously outputted code has the predetermined arrangement pattern), selecting the representative vector data most approximate to the currently inputted vector data only from the representative vector data belonging to the first group as indicated by the division instruction information stored in the memory means in the representative vector data stored in the codebook when the read binary data is "0", or selecting the representative vector data most approximate to the currently inputted vector data only from the representative vector data belonging to the second group as indicated by the division instruction information stored in the memory means in the representative vector data stored in the codebook when the read binary data is "1", the read binary data is combined with the code indicating the currently inputted vector data.

In other words, in the encoding method, only when the bit series of the currently outputted code has the predetermined arrangement pattern, the other binary data is embedded in the code to be outputted next.

Moreover, according to the encoding method, the code to be embedded with the other binary data can irregularly be limited, and the possibility that the combined data is deciphered by the third party can be reduced. Specifically, the third party who knows no determination content of the synthesis condition determination processing cannot specify the code combined with the other binary data.

On the other hand, by the decoding method, the vibration wave is restored and the binary data synthesized as described above can be separated from the code generated by the encoding method.

First, in an embodiment, the vibration wave is reproduced by the decoding procedure of the encoding system using the vector quantization. Moreover, in the decoding method, the same division instruction information as the division instruction information is stored in the predetermined memory means.

Moreover, particularly in the-decoding method, when the code generated by the encoding method is inputted, the same synthesis condition determination processing as the synthesis condition determination processing is performed on the previously inputted code.

Furthermore, when the affirmative determination is made by the synthesis condition determination processing (specifically, when it is determined that the bit series of the previously inputted code has the predetermined arrangement pattern), by determining that the code is combined with the binary data "0" when the number indicated by the currently inputted code is the number of the representative vector data belonging to the first group as indicated by the division instruction information stored in the memory means in the representative vector data stored in the codebook, and determining that the code is combined with the binary data "1" when the number indicated by the currently inputted code is the number of the representative vector data belonging to the second group as indicated by the division instruction information stored in the memory means in the representative vector data stored in the codebook, the other binary data is separated from the currently inputted code.

According to the decoding method, the vibration wave is reproduced and the other data can securely be extracted from the code generated by the encoding method.

Subsequently, in an embodiment, before the representative vector data most approximate to the currently inputted vector data is selected, with respect to the previously outputted code, the change condition determination processing is performed in which it is determined whether or not the bit series of the code has the predetermined arrangement pattern. When the affirmative determination is made by the change condition determination processing (specifically, when it is determined that the bit series of the previously outputted code has the predetermined arrangement pattern), the division instruction information to be stored in the memory means is changed in accordance with the predetermined change rule.

Therefore, in an embodiment, some characteristics can be prevented from appearing in each encoded code bit value, and the possibility that the third party notices the combining of the other data can further be reduced.

Moreover, according to the decoding method, the vibration wave is recovered and the binary data synthesized as described above can be separated from the code generated by the encoding method.

First, in one embodiment, the vibration wave is reproduced, and with the affirmative determination by the synthesis condition determination processing, the other binary data is separated from the currently inputted code. Furthermore, the same change condition determination processing as the change condition determination processing is performed on the previously inputted code before performing the synthesis condition determination processing. When the affirmative determination is made by the change condition determination processing, the division instruction information to be stored in the memory means is changed in accordance with the same change rule as the change rule.

Moreover, according to the decoding method, the division instruction information can be changed in the same manner as in the encoding method, and as a result, the other binary data can securely be extracted from the code generated by the encoding method.

DETAILED DESCRIPTION OF THE INVENTION

An embodiment of the present invention will be described hereinafter with reference to the drawings. Additionally, the embodiment of the present invention is not limited to the following embodiment, and needless to say various modes can be employed within the technical scope of the present invention.

Figure 1:
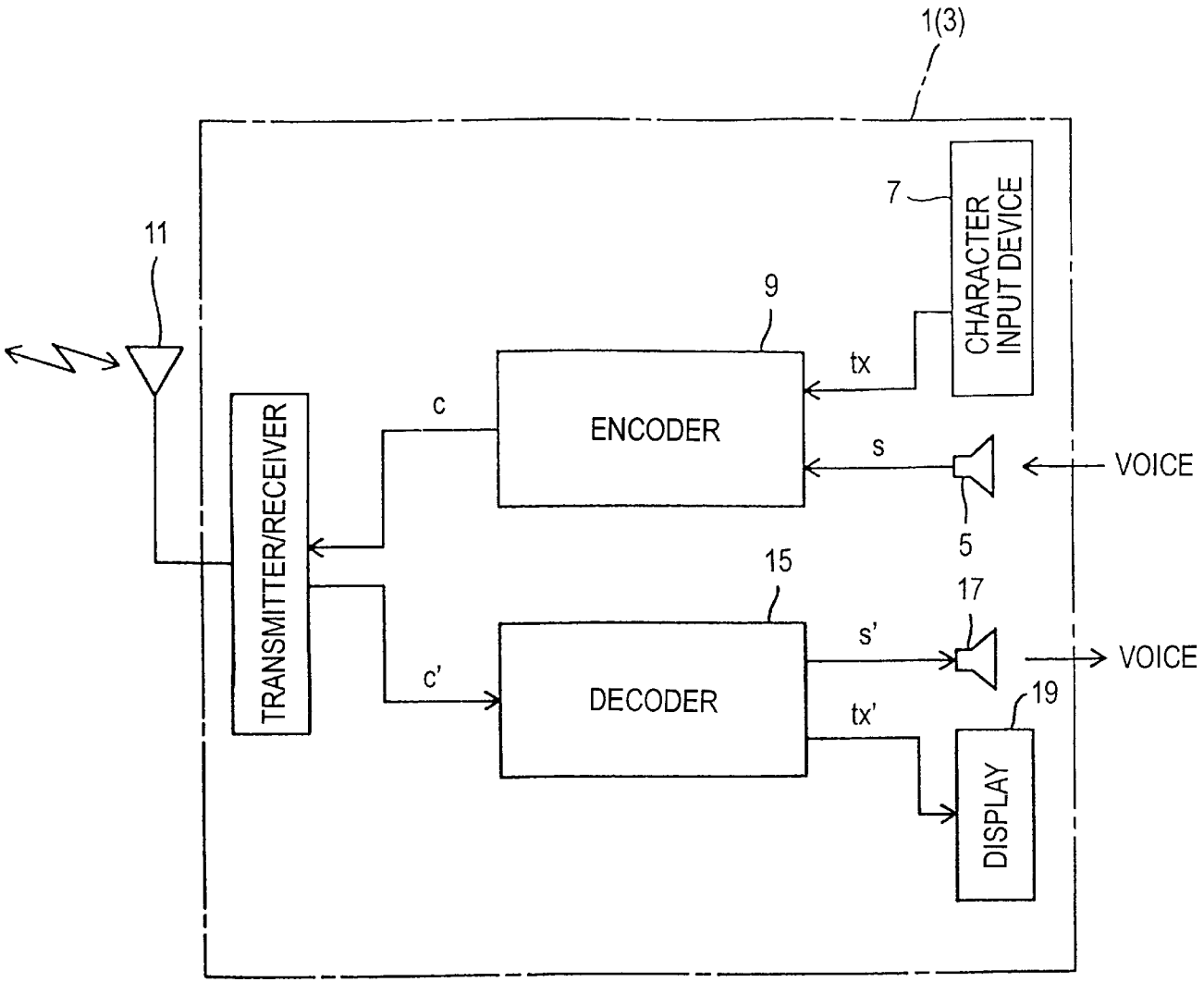
FIG. 1 is a block diagram showing a digital telephone set of an embodiment.

First, FIG. 1 is a block diagram showing a digital telephone set (hereinafter referred to simply as the telephone set) of the embodiment. Additionally, in the present embodiment, the present invention is applied to a portable digital telephone set in which the encoding and decoding of a voice waveform are performed by the aforementioned 16 kbit/s LD-CELP system of ITU-T Recommendation G.728 (hereinafter referred to simply as G.728 LD-CELP). Moreover, in the following description, another telephone set 3 is constituted in the same manner as the telephone set 1 shown in FIG. 1, as shown by reference numerals in parentheses in FIG. 1.

As shown in FIG. 1, the telephone set 1 of the present embodiment is provided with: a voice input device 5 for inputting voice and performing sampling every predetermined time (8 kHz: every 0.125 ms in the present embodiment) to successively output a digital voice signal s indicating the instantaneous amplitude value of the voice waveform; a character input device 7, provided with a multiplicity of input keys for inputting characters, for successively storing a bit series tx of text data corresponding to the characters inputted by the input keys; an encoder 9 for successively receiving the digital voice signals s from the voice input device 5, encoding the digital voice signals s by G.728 LD-CELP, combining encoded codes with the respective bits of the bit series tx stored in the character input device 7, and outputting a voice code c to be transmitted; and a transmitter/receiver 13 for radio modulating the voice code c outputted from the encoder 9 to transmit-an output via an antenna 11, receiving via the antenna 11 the radio signal transmitted from the other telephone set 3 via a relay station (not shown), demodulating the received signal and outputting a voice code c' from the other telephone set 3.

Furthermore, the telephone set 1 is provided with a decoder 15 for successively inputting the voice code c' outputted from the other telephone set 3 via the transmitter/receiver 13, decoding the voice code c' by G.728 LD-CELP to output a digital voice signal s' and extracting and outputting the respective bits of a bit series tx' of text data from the voice code c'; a voice output device 17 for reproducing and outputting voice from a digital voice signal s' outputted from the decoder 15; and a display 19 for reproducing and displaying the characters from the bit series tx' outputted from the decoder 15.

Figure 2A:
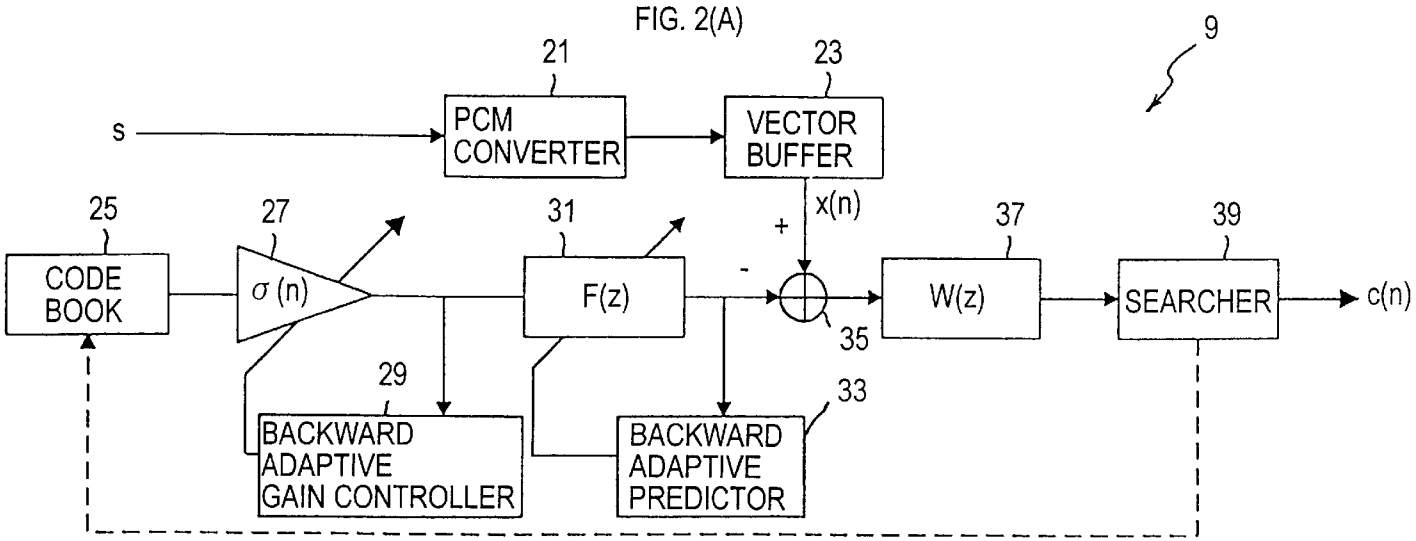
FIG. 2 is a block diagram showing a basic processing outline of voice encoding and decoding performed in an encoder and a decoder of FIG. 1.
Figure 2B:
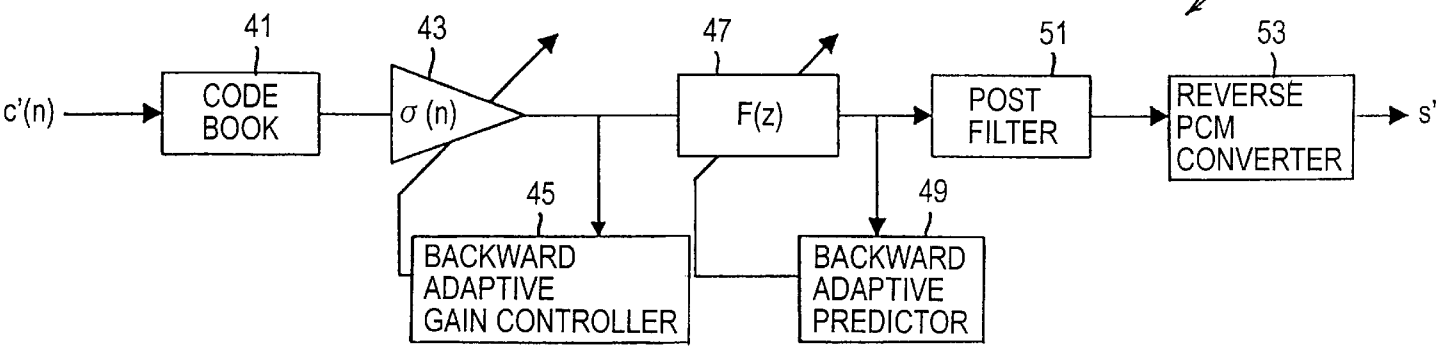

Here, the basic processing outlines of encoding and decoding of the voice by G.728 LD-CELP performed in the encoder 9 and decoder 15 will be described with reference, to FIG. 2. Additionally, FIG. 2(A) is a block diagram showing the processing outline in the encoder 9, and FIG. 2(B) is a block diagram showing the processing outline in the decoder 15. Additionally, in the encoder 9 and decoder 15, in practice, a known microcomputer or a digital signal processor (DSP) is constituted as a main part. First, as described in the aforementioned document 1, G.728 LD-CELP is a system in which the size of one frame is set to five samples (i.e., every five digital voice signals s obtained by sampling with 8 kHz are used as one frame), reduced delay is realized, and a high-quality voice can be reproduced. Moreover, in G.728 LD-CELP, each frame of the digital voice signal s is encoded to provide the voice code c as the binary data of ten digits (10 bits).

Additionally, in the following description, n in parentheses denotes an order label indicating the order of each frame of the digital voice signal s. Therefore, for example, "c(n)" indicates the 10-bit voice code c corresponding to the n-th frame of the digital voice signal s.

Moreover, as shown in FIG. 2(A), in order to perform the encoding of the voice by G.728 LD-CELP, the encoder 9 is provided with: a PCM converter 21 for successively inputting the digital voice signal (hereinafter also referred to as the input voice signal) s from the voice input device 5, converting the signal s to a PCM signal and outputting the signal; a vector buffer 23 for storing every five PCM signals (i.e., every frame) successively outputted from the PCM converter 21, and outputting the five PCM signals as vector data (hereinafter referred to as VQ target vector) x(n) indicating a five-dimensional vector as a vector quantization object; and an excitation waveform codebook 25 for storing 1024 types of representative vector data numbered beforehand in order from 0. Additionally, the excitation waveform codebook 25 is constituted by nonvolatile memory such as ROM disposed on the encoder 9.

Furthermore, in order to search and select the representative vector data most approximate to the VQ target vector x(n) from the excitation waveform codebook 25 based on a technique of analysis by synthesis (Abs), the encoder 9 is provided with: an amplifier 27 for amplifying the signal indicated by the representative-vector data selected from the excitation waveform codebook 25 by a 10-dimensional backward, adaptive gain $\sigma(n)$ set by a backward adaptive gain controller 29; a filter section 31 and a backward adaptive predictor 33 which form a 50-dimensional backward adaptive linear prediction filter F(z) for filtering the output of the amplifier 27; an adder 35 for outputting a difference between the VQ target vector x(n) from the vector buffer 23 and the output of the filter section 31; a filter section 37 which forms an acoustic weighing filter W(z) for filtering the output of the adder 35; and a searcher 39 for switching the representative vector data in the excitation waveform codebook 25 to be inputted to the amplifier 27 based on the output of the filter section 37, and outputting the 10-bit binary data indicating the number of the representative vector data as the voice code c(n) indicating the VQ target vector x(n) to the transmitter/receiver 13 when the representative vector data most approximate to the VQ target vector x(n) can be searched.

The basic procedure of a processing performed in the encoder 9 will next be described in which representative vector data y(n) most approximate to the VQ target vector x(n) obtained from the n-th input voice vector v(n) (i.e., one set of five input voice signals s forming the n-th frame) is selected from the excitation waveform codebook 25, and the binary data indicating the number of the selected representative vector data y(n) is outputted as the voice code c(n). Additionally, this procedure is described in the aforementioned document 1.

First, in the present embodiment, in accordance with the ITU-T Recommendation G.728, in order to facilitate the selection of the representative vector data y(n), the excitation waveform codebook 25 is divided into two independent codebooks: a waveform codebook (see FIG. 3) for storing 128 types of representative vector data indicating the waveform (hereinafter referred to as the waveform code) yj; j=0, 1, . . . , 127; and a gain codebook for storing eight types of representative vector data indicating waveform polarities and scholar values (hereinafter referred to as the gain code) gi; i=0, 1, . . . , 7.

Additionally, denotes the number of the waveform code yj stored in the waveform codebook, and "i" denotes the number of the gain code gi stored in the gain codebook.

Moreover, the encoder 9 uses the 50-dimensional backward linear predictor adaptation filter F(z) in the n-th input voice vector v(n), acoustic weighing filter W(z), and 10-dimensional backward adaptive gain σ(n), and performs search based on the technique of analysis by synthesis (Abs).

Specifically, first, by setting a filter H(z) of the backward adaptive linear prediction filter F(z) and acoustic weighing filter W(z) to H(z)=F(z)W(z), and setting a matrix of an impulse response series h(k); k=0, 1, . . . , 4 to H represented in the following equation 1, output oxij of the filter section 31 is obtained as in the following equation 2.

$$H=\begin{bmatrix} h(0) & 0 & 0 & 0 & 0 \\ h(1) & h(0) & 0 & 0 & 0 \\ h(2) & h(1) & h(0) & 0 & 0 \\ h(3) & h(2) & h(1) & h(0) & 0 \\ h(4) & h(3) & h(2) & h(1) & h(0) \end{bmatrix} \quad \text{Equation 1}$$

$$oxij=\sigma(n)\cdot gi\cdot H\cdot yj \quad \text{Equation 2}$$

Subsequently, oxij is used to search i, j which minimize D shown in the following equation 3. Additionally, in the equation 3, for x' (n), x' (n)=x(n)/σ(n).

$$D=\|x(n)-oxij\|^2 \quad \text{Equation 3}$$
$$=o^2(n)\|x'(n)-gi\cdot H\cdot yj\|^2$$

Here, this equation 3 can be developed as in the following equation.4.

$$D=o^2(n)\,[\|x'(n)\|^2-2\cdot gi\cdot x'^T(n)\cdot H\cdot yj+gi^2\|H\cdot yj\|^2] \quad \text{Equation 4}$$

In this case, since the values of $\|x'(n)\|^2$ and $\sigma^2(n)$ are constant during the searching of the optimum representative vector data y(n), the minimizing of D equals the minimizing of D' shown in the following equation 5.

$$D'=-2\cdot gi\cdot p^T(n)\cdot yk+gi^2\cdot Ej \quad \text{Equation 5}$$

Additionally, p(n) is represented by the following equation 6, and Ej is represented by the following equation 7.

$$p(n)=H^T\cdot x'(n) \quad \text{Equation 6}$$

$$Ej=\|H\cdot yj\|^2 \quad \text{Equation7}$$

This Ej does not depend on x' (n), and depends only on the matrix H of the equations1. Therefore, in the encoder 9, by calculating Ej; j=0, 1, . . . , 127 in accordance with the ITLU-T Recommendation G.728 only when the filter H(z) is updated, the calculation amount is remarkably reduced. Moreover, by calculating bi, ci beforehand by the following equation 8, the calculation processing is further simplified.

$$bi=2gi,\ ci=gi^2;\ i=0, 1, \ldots, 7 \quad \text{Equation 8}$$

When these are used, D' of equation 5 is shown in the following equation 9. Additionally, in the equation 9, for Pj, $Pj=p^T(n)\cdot yj$.

$$D'=bi\cdot Pj+ci\cdot Ej \quad \text{Equation 9}$$

Subsequently, the encoder 9 uses the equation 9, evaluates D' with respect to all combinations of i and j, determines a gain code gi (hereinafter referred to as gimin) and a waveform code yj (hereinafter referred to as yjmin) which minimize D', obtains y(n)=gimin yjmin, and calculates the optimum representative vector data y(n) in the excitation waveform codebook 25.

Furthermore, the encoder 9 connects 3-bit binary data indicating the number imin of the gain code gimin and 7-bit binary data indicating the number jmin of the waveform code yjmin in this order to constitute a 10-bit voice code c(n), and outputs the voice code c(n).

On the other hand, when there is no error in a transmission line, the voice code c'(n) outputted from the encoder 9 from the other telephone set 3, which is the same as the voice code c(n), is successively inputted to the decoder 15 via the antenna 11 and transmitter/receiver 13.

Moreover, as shown in FIG. 2(B), in order to perform the decoding of the voice by G.728 LD-CELP, the decoder 15 is provided with an excitation waveform codebook 41 which is the same as the excitation waveform codebook 25 on the side of the encoder 9. Additionally, the excitation waveform codebook 41 is also constituted of the nonvolatile memory such as ROM disposed on the decoder 15.

Furthermore, the decoder 15 is provided with an amplifier 43, backward adaptive gain controller 45, filter section 47, and backward adaptive predictor 49, similarly to the amplifier 27, backward adaptive gain controller 29, filter section 31, and backward adaptive predictor 33 disposed on the encoder 9, and is further provided with a post filter 51 for further filtering the output of the filter section 47, and a reverse PCM converter 53 for generating the digital voice signal s' indicating the instantaneous amplitude value of the voice waveform from the output signal of the post filter 51 and outputting the signal to the voice output device 17.

Moreover, every time the voice code c'(n) from the other telephone set 3 is inputted, the decoder 15 extracts the representative vector data with the number indicated by the voice code c'(n) from the excitation waveform codebook 41, reproduces the digital voice signal s'(n) for one frame corresponding to the voice code c'(n) by the amplifier 43, backward adaptive gain controller 45, filter section 47, backward adaptive predictor 49, post filter 51, and reverse PCM converter 53 based on the extracted representative vector data, and outputs the signal to the voice output device 17.

As described above, the encoder 9 and decoder 15 disposed on the telephone sets 1,3 of the present embodiment perform the encoding and decoding of the voice by G.728 LD-CELP, but particularly in the telephone sets 1, 3 of the present embodiment, as described in the following <1> to <3>, the encoder 9 combines the voice code c to be outputted with the respective bits of the bit series tx of the text data stored in the character input device 7, and the decoder 15 separates/extracts the bit of the bit series tx' of the text data from the inputted voice code c'.

<1> First, the basic principle for combining the voice code c with the text data bit will be described.

In the present embodiment, dividing key data $k_{idx}$ as division instruction information indicating that the respective waveform codes yj; j=0,1, . . . , 127 stored in the aforementioned waveform codebook belong to a first group or a second group is stored beforehand in the ROM (not shown) disposed on the encoder 9 and decoder 15, and the encoder 9 and decoder 15 transfer the dividing key data. $k_{idx}$ to RAM (not shown) as memory means from the ROM for use.

Figure 3:
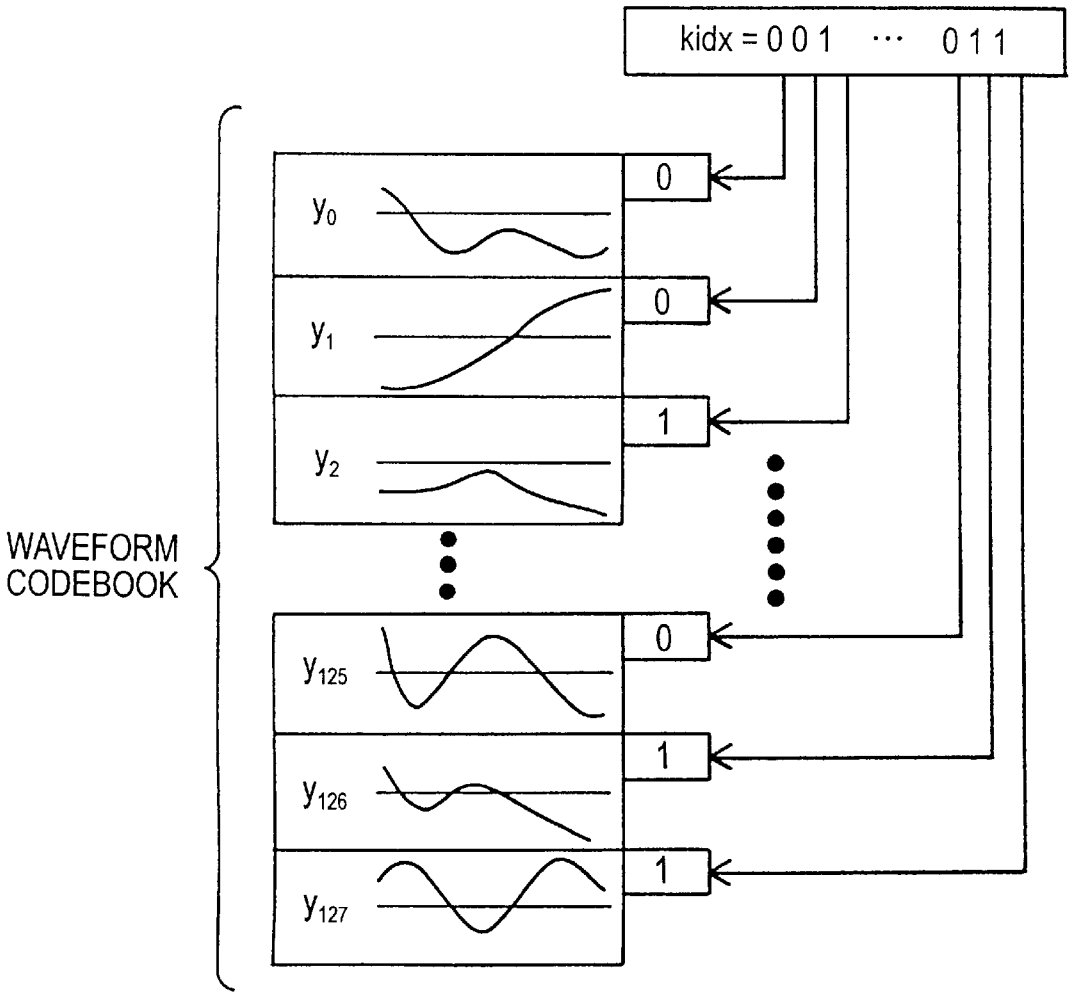
FIG. 3 is an explanatory view showing a waveform codebook and dividing key data $k_{idx}$.

Additionally, as shown in FIG. 3, the dividing key data $k_{idx}$ includes the same 128-digit (128-bit) binary number as the number of the waveform code yj; j=0, 1, . . . , 127 stored in the waveform codebook, and the respective waveform codes yi; j=0, 1, . . . , 127 are labeled with "0" or "1" in the order from the uppermost bit. Moreover, in the present embodiment, among the respective bits of the dividing key data $k_{idx}$, the waveform code yj corresponding to the bit with the value "0" belongs to the first group, and among the respective bits of the dividing key data $k_{idx}$, the waveform code yj corresponding to the bit with the value "1" belongs to the second group.

Furthermore, when the j-th bit from the uppermost bit of the dividing key data $k_{idx}$ (i.e., the bit value of the dividing key data $k_{idx}$ corresponding to the j-th waveform code yj) is $k_{idx}(j)$, the encoder 9 combines the voice code c(n) with the text data bit by the following synthesis method.

Synthesis Method

When the bit to be combined is "0", yjmin (i.e., the waveform code yj which minimizes D' of the equations 5 and 9) is selected only from the waveform code yj satisfying $k_{idx}(j)$="0" (i.e., the waveform code yj belonging to the first group as indicated by the dividing key data $k_{idx}$), or conversely when the bit to be combined is "1", yjmin is selected only from the waveform code yj satisfying $k_{idx}(j)$="1" (i.e., the waveform code yj belonging to the second group as indicated by the dividing key data $k_{idx}$), so that the voice code c(n) indicating the currently inputted VQ target vector x(n) is combined with the text data bit.

When the text data bit is combined in this procedure with the bit "0" to be combined, the lower seven bits of the voice code c(n) to be outputted (i.e., j included in the voice code c(n)) form the binary data indicating any number of the waveform code yj belonging to the first group, and conversely with the bit "1" to be combined, the lower seven bits of the voice code c(n) to be outputted form the binary data indicating any number of the waveform code yj belonging to the second group.

Specifically, in the present embodiment, by switching the selection range of the waveform codes yj; j=0, 1, . . . , 127 in the waveform codebook to the first group and the second group determined by the dividing key data $k_{idx}$ in accordance with the value of the bit to be combined, the text data bit is combined with (embedded in) the voice code c(n).

On the other hand the decoder 15 separates/extracts the combined bit from the voice code c'(n) combined with the text data bit in the aforementioned procedure by the following separation method.

Separation Method

When the lower seven bits of the voice code c'(n) (i.e., j included in the voice code c'(n)) are the binary data indicating the number of the waveform code yj belonging to the first group as indicated by the dividing key data $k_{idx}$, it is determined that the voice code c'(n) is combined with the bit with the value "0", conversely when the lower seven bits of the voice code c'(n) are the binary data indicating the number of the waveform code yj belonging to the second group as indicated by the dividing key data $k_{idx}$, it is determined that the voice code c'(n) is combined with the bit with the value "1", and the text data bit is separated from the voice code c'1(n).

Particularly, in the present embodiment, as described above, since the waveform code yj corresponding to the bit "0" of the dividing key data $k_{idx}$ belongs to the first group, and the waveform code yj corresponding to the bit "1" of the dividing key data $k_{idx}$ belongs to the second group, j included in the voice code c'(n) is used to check $k_{idx}(j)$, it is determined that the bit "0" is combined for $k_{idx}(j)$="0", conversely it can be determined that the bit "1" is combined for $k_{idx}(j)$ ="1", and further the value of $k_{idx}$) can be extracted, as it is, as the value of the combined bit.

Moreover, according to the aforementioned synthesis and separation methods, only the person who knows the dividing key data $k_{idx}$ can extract the text data from the voice code. Therefore, during the voice encoding, the text data can secretly be combined, or the combined text data can secretly be extracted. Additionally, this characteristic is not limited to the case in which the text data bit is combined, and can similarly be applied to a case in which the bits constituting caller authentication data, and other data are combined.

Moreover, when the respective bit values of the dividing key data $k_{idx}$ are set at random, and for example, even if all the voice codes c(n) are combined with the bit "0", the number indicated by the lower seven bits of the encoded voice code c(n) fails to deviate, and the possibility that the third party notices the embedding of the other data can remarkably be lowered.

Additionally, according to the synthesis method, there is a great advantage that during the voice reproduction in the decoder 15, special processing is not at all necessary.

Here, every time before the representative vector data y(n) most approximate to the currently inputted VQ target vector x(n) is selected, the encoder input device 7, and combines the read bit with the voice code c(n) by the aforementioned synthesis method, so that the text data bits can be embedded in all the voice codes c(n).

Moreover, in this case, every time the voice code c'(n), is inputted, the decoder 15 may extract the text data bit from the inputted voice code c'(n) by the aforementioned separation method.

Furthermore, when the text data bits are embedded in all the voice codes c(n) in this manner, the embedding density (the number of bits combined per second) is 200 byte/s(= 1600 bit/s).

<2> Additionally, in consideration of a possibility that the third party deciphers the embedded data, when the data is embedded in all the voice codes c(n), there is also a disadvantage respect.

To solve the problem, in the present embodiment, by the method described as follows, the voice code c(n) to which the text data bit is embedded is irregularly limited, and the voice code c(n) subjected to embedding (i.e., whether or not the text data bit is combined) is kept secret from the third party.

Figure 4:
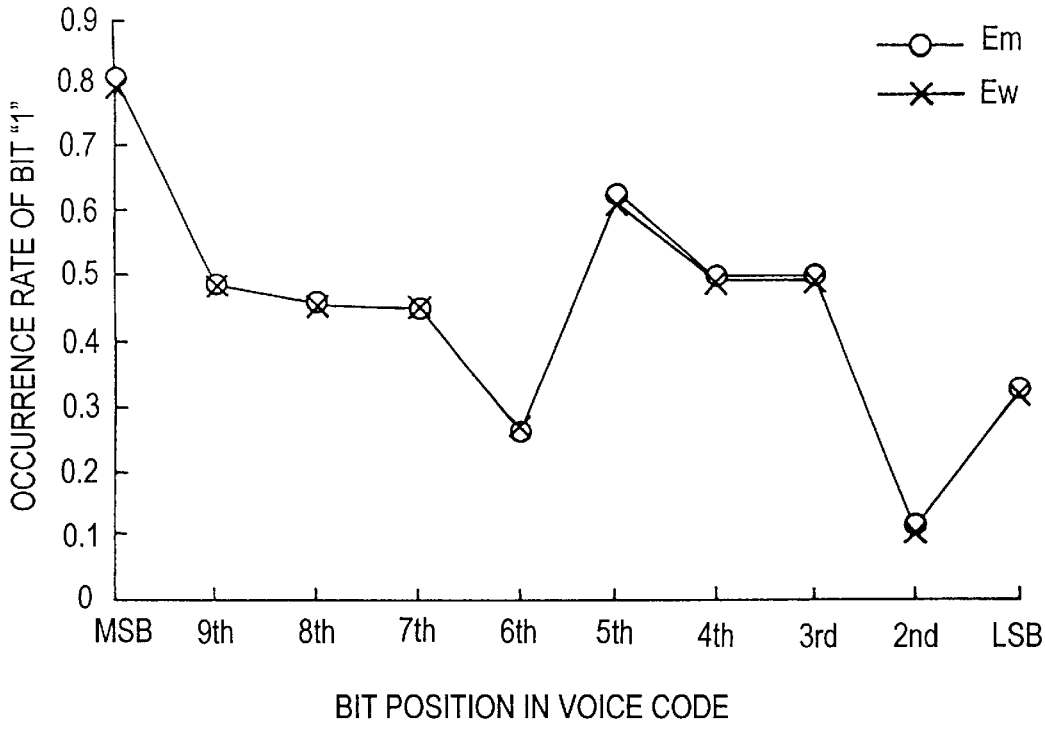
FIG. 4 is a graph showing the occurrence rate of bit "1" in the respective bit positions of a voice code.

First, with respect to the voice codes obtained by encoding voices "Em", "Ew" shown in the following [Table 1] by G.728 LD-CELP, when the occurrence rate of bit "1" in the respective bit positions of the voice code is checked, the result is obtained as shown in FIG. 4. Additionally, in [Table 1] and the following description, "Jm" indicates a voice in Japanese by a male (Japanese male voice), "Jw" indicates a voice in Japanese by a female (Japanese female voice), "Em" indicates a voice in English by a male (English male voice), and "Ew" indicates a voice in English by a female (English female voice). Moreover, the voice was extracted for every five seconds from FM radio and conversation tape as the voice source of the respective sounds shown in [Table 1]. Therefore, the number of samples for each voice is 40000.

TABLE 1

Voice for Experiment

| | LANGUAGE | GENDER | NO. OF SAMPLES | TIME (SECONDS) |
|---|---|---|---|---|
| Jm | JAPANESE | MALE | 40,000 | 5 |
| Jw | JAPANESE | FEMALE | 40,000 | 5 |
| Em | ENGLISH | MALE | 40,000 | 5 |
| Ew | ENGLISH | FEMALE | 40,000 | 5 |

Here, it is seen from FIG. 4 that the occurrence rate of the bit value included in the voice code encoded by G.728 LD-CELP is characteristic. Then, it is considered that with utilization of this characteristic, the embedding density of the data to the voice code can be controlled.

Moreover, since the respective bit values of the voice code depend on the input voice, the value is usually irregular. Then, in the present embodiment, by utilizing this irregularity and the characteristic seen in FIG. 4, the voice code subjected to embedding is irregularly limited, and the embedding density is controlled.

First, in the present embodiment, in addition to the aforementioned dividing key data $k_{idx}$, limiting key data $k_{lim}$ for irregularly limiting the voice code subjected to embedding is stored beforehand in the ROMs disposed on the encoder 9 and decoder 15, and the encoder 9 and decoder 15 transfer the limiting key data $k_{lim}$ to RAMs from ROMs for use. Additionally, the limiting key data $k_{lim}$ includes a 10-digit (10-bit) binary number in the same manner as the bit number of the voice code c(n).

Subsequently, the encoder 9 calculates a value L from the limiting key data $k_{lim}$ and the currently outputted voice code c(n) by the following equation 10 before selecting the optimum representative vector data y(n+1) with respect to the next VQ target vector x(n+1). Additionally, this is performed in the same manner as when the value L is obtained from the limiting key data $k_{lim}$ and the previously outputted voice code c(n−1) before selecting the optimum representative vector data y(n) with respect to the current VQ target vector x(n). Moreover, [AND] represents a logical product.

$$L = klim[AND]c(n) \qquad \text{Equation 10}$$

Specifically, L is a logical product value of the limiting key data $k_{lim}$ and the voice code c(n). Therefore, when the bit series of the voice code c(n) has an arrangement pattern in which all the bits in the same positions as the bit positions with the value "1" in the limiting key data $k_{lim}$ are "0", the value of L is 0. Conversely, when the bit series of the voice code c(n) has an arrangement pattern in which any bit in the same positions as the bit positions with the value "1" in the limiting key data $k_{lim}$ is "1", the value of L is other than 0.

Furthermore, when the value of L is 0, the encoder 9 determines that the synthesis condition is established, reads one bit from the bit series tx of the text data from the character input device 7, and combines the read bit with the currently outputted voice code by the aforementioned synthesis method. Conversely, when the value of L is not 0, the encoder 9 determines that the synthesis condition is not established, and performs the usual encoding by G.728 LD-CELP without reading the text data bits from the character input device 7.

Moreover, in the present embodiment, an embedding code (i.e., the voice code subjected to the embedding) is limited by this method.

For example, when all the voice codes are subjected to the embedding, $k_{lim}$="0000000000" may be set. Conversely, when the embedding is hardly performed, $k_{lim}$="1111111111" may be set. Moreover, when substantially the half amount of the voice codes are subjected to the embedding, $k_{lim}$="0100000000" or the like may be set. Additionally, as shown in FIG. 4, this is because the 9-th bit from the lowermost bit of the voice code is bit "1" at a probability of about 0.5.

Here, when the occurrence rate of bit "1" in the respective bit positions of the voice code shown in FIG. 4 is pi, and the bit value of the x-th bit from the lowermost bit of the limiting key data $k_{lim}$ (x=1, 2, . . . , 10) is $k_{lim}(x)$, the embedding density Embrate [bit/s] can roughly be calculated by the following equation 11.

$$\text{Embrate} = 1600\prod_{x=1}^{10}(1 - pi \cdot klim(x)) \qquad \text{Equation 11}$$

The embedding density can be estimated to some degree in this manner. On the other hand, the voice code to be embedded depends on the input voice and is unspecified.

Therefore, it is remarkably difficult for the third party who does not know the limiting key data $k_{lim}$ to correctly specify the voice code subjected to embedding from a large amount of voice codes.

On the other hand, in this case, the decoder 15 may obtain L of the equation 10 with respect to the previously inputted voice code c'(n−1), and extract the text data bit from the currently inputted voice code c'(n) by the aforementioned separation method only when the value of L is 0. In other words, the decoder may obtain L of the equation 10 with respect to the currently inputted voice code c'(n), and extract the text data bit from the next inputted voice code c'(n+1) by the aforementioned separation method when the value of L is 0.

<3> On the other hand, when the same dividing key data $k_{idx}$ is used for a long time, some characteristics appear in the bit value of the voice code, and the third party possibly notices that the other data is combined.

Furthermore, in the present embodiment, the analysis of the dividing key data $k_{idx}$ by the third party is complicated by frequently changing the dividing key data $k_{idx}$ shared by the encoder 9 and decoder 15 by the method described as follows.

First, in the present embodiment, in addition to the aforementioned dividing key data $k_{idx}$ and limiting key data $k_{lim}$, reverse key data $k_{rev}$ and change key data $k_{xor}$ are further stored beforehand in the ROMs disposed on the encoder 9 and decoder 15, and the encoder 9 and decoder 15 transfer the reverse key data $k_{rev}$ and change key data $k_{xor}$ to RAM from ROM and use the data.

Additionally, the reverse key data $k_{rev}$ includes the 10-digit (10-bit) binary number similarly to the limiting key data $k_{lim}$. Moreover, the change key data $k_{xor}$ determines the change rule of the dividing key data $k_{idx}$, and includes the 128-digit (128-bit) binary number similarly to the dividing key data $k_{idx}$.

Subsequently, the encoder 9 obtains a value r from the reverse key data $k_{rev}$ and the currently outputted voice code c(n) by the following equation 12 before selecting the optimum representative vector data y(n+1) with respect to the next VQ target vector x(n+1). Additionally, this is performed in the same manner as when the value r is obtained from the reverse key data $k_{rev}$ and the previously outputted voice code c(n−1) before selecting the optimum representative vector data y(n) with respect to the current VQ target vector x(n).

$$r=k_{rev}[\text{AND}]c(n) \qquad \text{Equation 12}$$

Specifically, r is a logical product value of the reverse key data $k_{rev}$ and voice code c(n). Therefore, similarly to the aforementioned equation 10, when the bit series of the voice code c(n) has an arrangement pattern in which all the bits in the same positions as the bit positions with the value "1" in the reverse key data $k_{rev}$ are "0", the value of r is 0. Conversely, when the bit series of the voice code c(n) has the arrangement pattern in which any bit in the same positions as the bit positions with the value "1" in the reverse key data $k_{rev}$ is "1", the value of r is other than 0.

Furthermore, when the value of r is not 0, the encoder 9 determines that the change condition to change the dividing key data $k_{idx}$ is established, reads the current dividing key data $k_{idx}$ from the RAM, reverses the bit "0" and bit "1" of the dividing key data $k_{idx}$ by the following equation 13 and stores the updated data in the RAM. Additionally, [XOR] represents an exclusive logical sum.

$$kidx=kidx[XOR]kxor\ tm\ Equation\ 13$$

For example, when 128 bits of the change key data $k_{xor}$ are all "1", by the equation 13, all "0" and "1" of the dividing key data $k_{idx}$ are reversed.

Conversely, when the value of r is 0, the encoder 9 determines that no change condition is established and continues to use the current dividing key data $k_{idx}$.

On the other hand, in this case, the decoder 15 may obtain r of the equation 12 with respect to the previously inputted voice code c'(n−1), and change the currently used dividing key data $k_{idx}$ by the equation 13 in the same manner as in the encoder 9 when the value of r is not 0. In other words, the decoder may obtain r of the equation 12 with respect to the currently inputted c'(n), change the currently used dividing key data $k_{idx}$ by the equation 13 when the value of r is not 0, and use the changed dividing key data $k_{idx}$ from the next time.

According to this method, since the dividing key data $k_{idx}$ is irregularly changed, the possibility that the third party who does not know the reverse key data $k_{rev}$ or the change key data $k_{xor}$ deciphers the data embedded in the voice code can remarkably be reduced.

Additionally, instead of changing the dividing key data $k_{idx}$ by the calculation as shown in the equation 13, it is also possible to prepare a plurality of types of dividing key data $k_{idx}$ and change the data.

Figure 5:
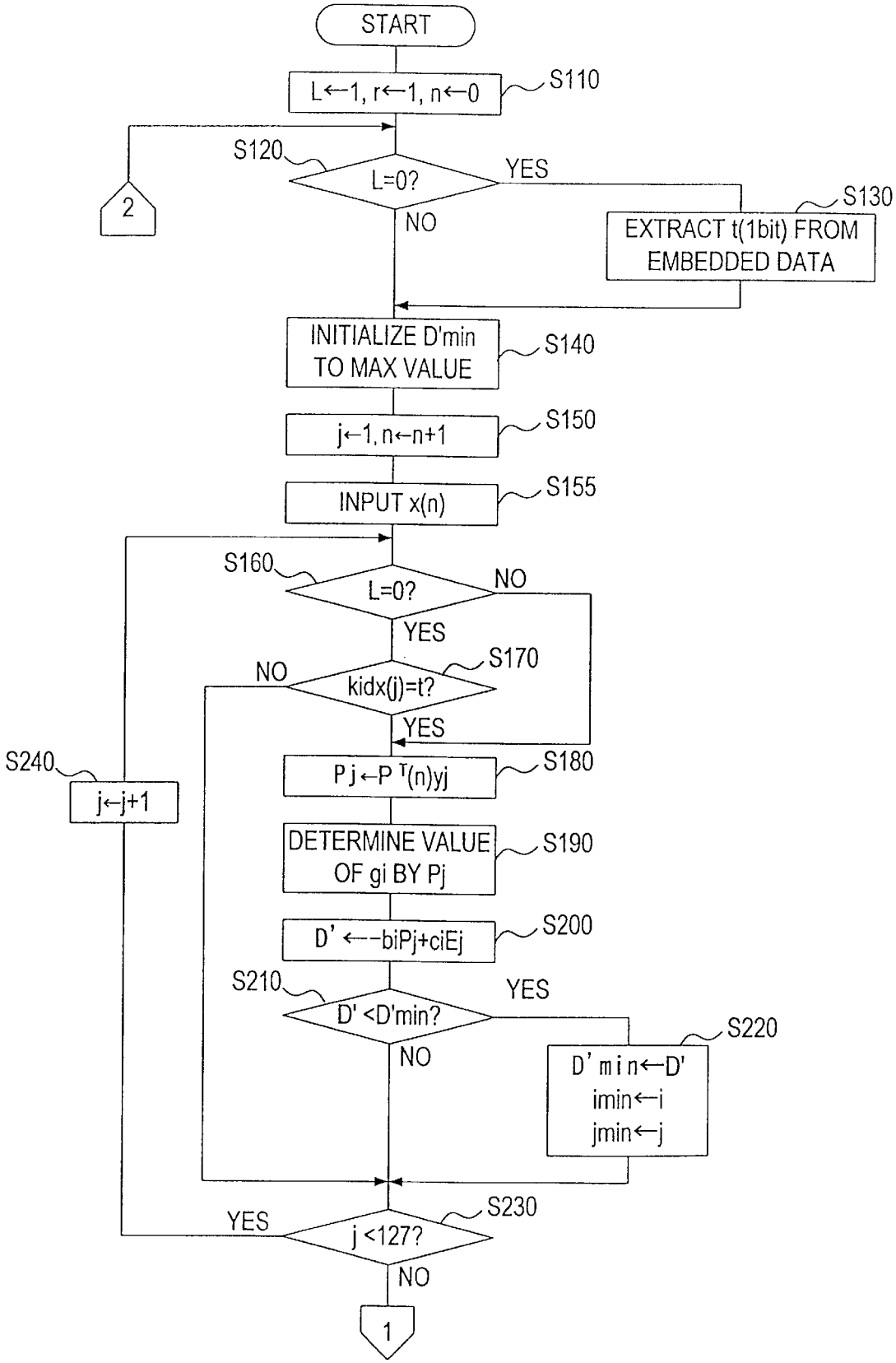
FIG. 5 is a flowchart showing the first half part of an operation content of the encoder.
Figure 6:
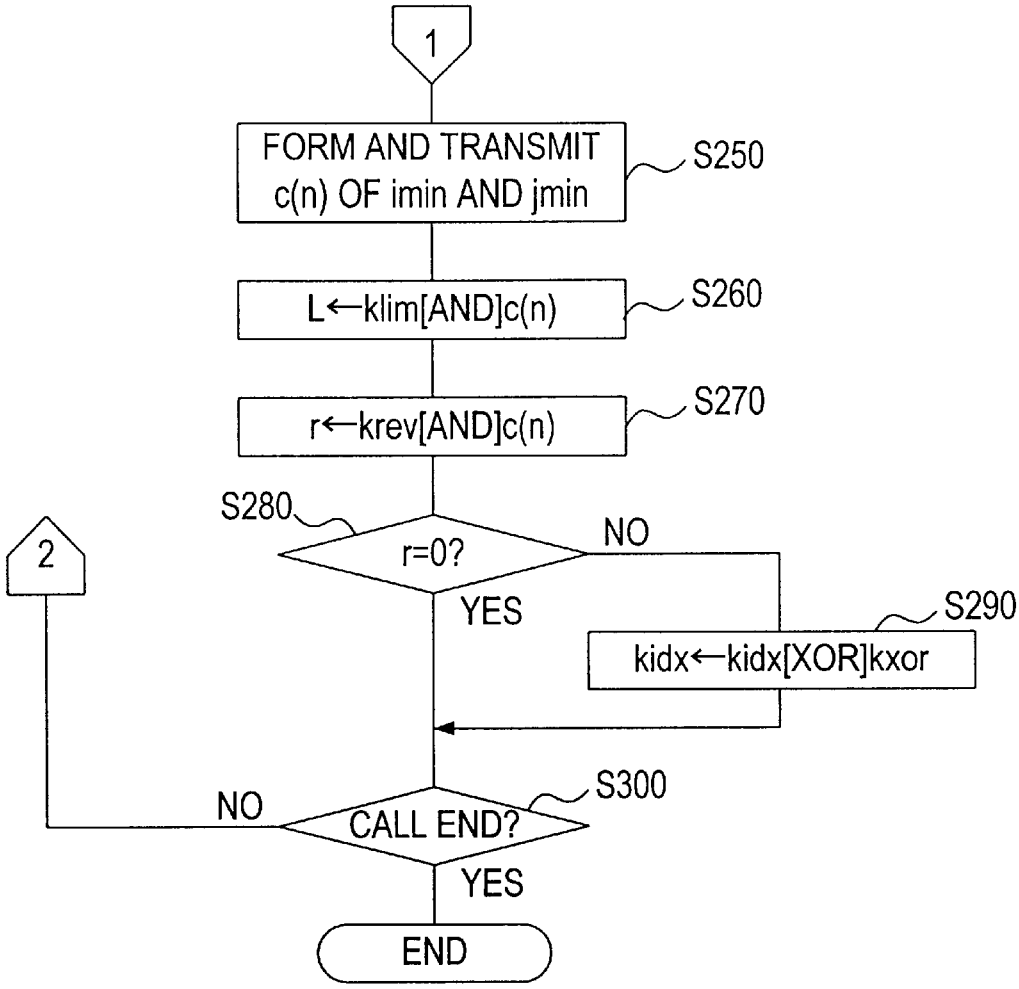
FIG. 6 is a flowchart showing the latter half part of the operation of the encoder.
Figure 7:
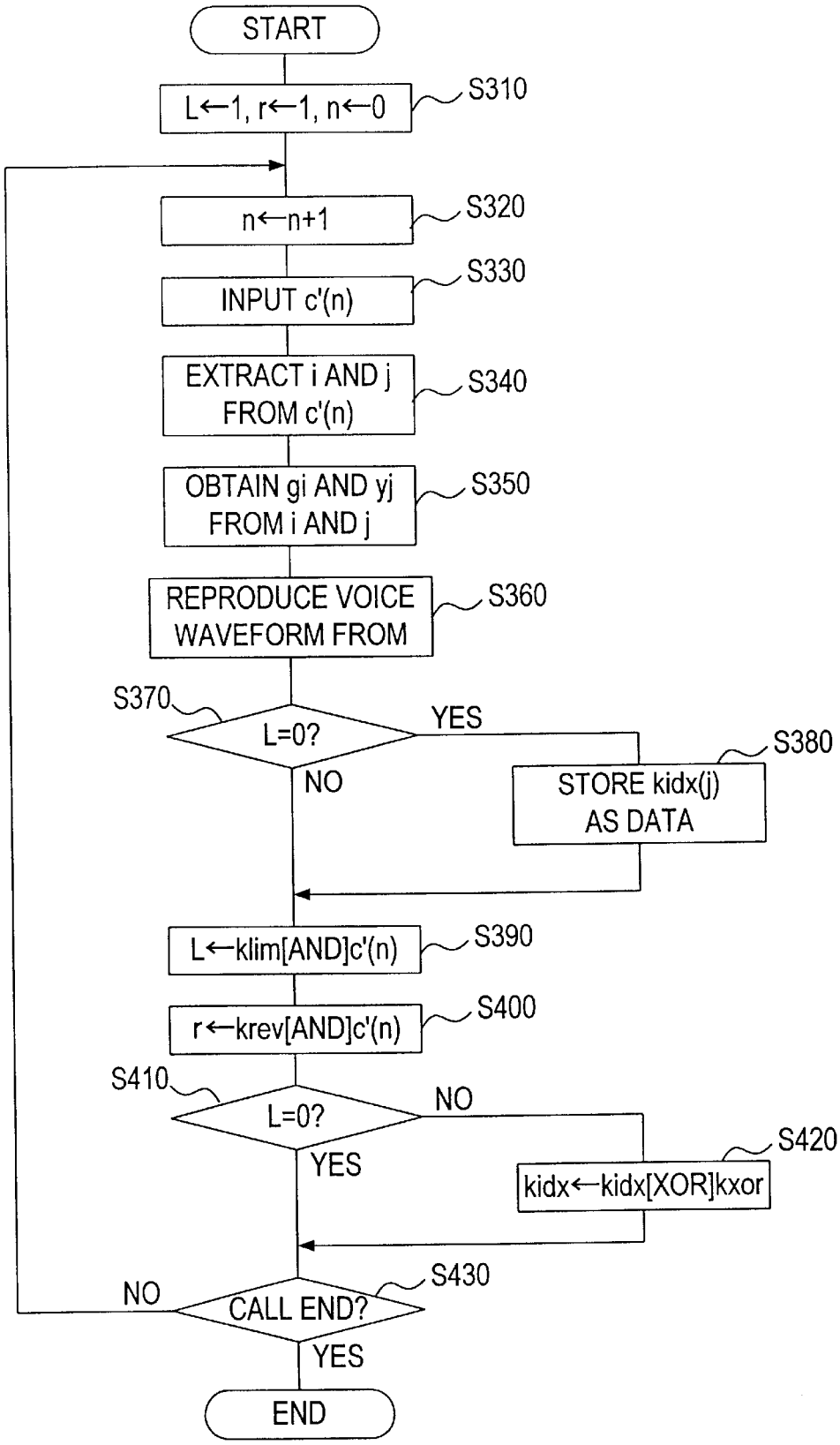
FIG. 7 is a flowchart indicating the operation of the decoder.

Here, the aforementioned operation contents of the encoder 9 and decoder 15 are summarized as shown in flowcharts of FIGS. 5 to 7. Additionally, FIG. 5 is a flowchart showing the first half of the operation of the encoder 9, and FIG. 6 is a flowchart showing the last half of the operation of the encoder 9. Moreover, FIG. 7 is a flowchart showing the operation of the decoder 15.

First, as shown in FIG. 4, when the encoder 9 starts its operation, in a first step (hereinafter referred to simply as S) 110, the encoder initializes/sets the aforementioned values of L and r to 1, and initializes/sets the value of n as the frame order label to 0.

Subsequently, in S120, the encoder determines whether or not the value of L is 0, and the process advances, as it is, to S140 when the value of L is not 0 (S120:NO), but shifts to S130 when the value of L is 0 (S120: YES) to extract one bit t to be combined with the voice code from the embedded data (i.e., the bit series tx of the text data stored in the character input device 7), and subsequently advances to S140.

Subsequently, in S140, the value of D'min as a candidate for the minimum value of D' is initialized to provide a predicted maximum value, and subsequently in S150, the value of j is initialized to 0, and the value of n is incremented by 1. Furthermore, subsequently in S155, the n-th VQ target vector x(n) to be currently quantized is inputted, and subsequently in S160, it is determined whether the value of L is 0 or not.

Here, when the value of L is not 0 (S160: NO), the process advances to S180 as it is. When the value of L is 0 (S160: YES), however, the process shifts to S170, in which it is determined whether or not the j-th bit $k_{idx}(j)$ from the uppermost bit of the dividing key data $k_{idx}$ is equal to the bit t extracted in S130. When $k_{idx}(j)=t$ (S170:YES), the process advances to S180.

Subsequently, in S180, the aforementioned Pj ($=P^T(n)\cdot yj$) is obtained with respect to the VQ target vector x(n) currently inputted in the above S155, subsequently in S190, gi is determined by Pj, and further in S200, D' ($=-bi\cdot Pj+ci\cdot Ej$) is obtained by the aforementioned equation 9.

Subsequently, it is determined in the next S210 whether or not D' obtained in S200 is smaller than the current D'min. When D'<D'min is not satisfied (S210:NO), the process advances to S230 as it is. When D'<D'min (S210: YES), however, the process shifts to S220, in which D' currently obtained in S200 is set as D'min, and i and j during the obtaining of D' in S200 are set to imin and jmin, respectively, and the process then advances to S230.

Moreover, when it is determined in the above S170 that $k_{idx}(j)=t$ is not satisfied (S170: YES), the process advances to S230 as it is without performing the processing of S180 to S220.

Subsequently, it is determined in S230 whether or not the value of j is smaller than 127. When j<127 (S230: YES), the process advances to S240, increments the value of j by 1, and returns to S160.

On the other hand, when it is determined in S230 that j<127 is not satisfied (S230: NO), the process shifts to S250 shown in FIG. 6.

Subsequently, as shown in FIG. 6, in S250, the 10-bit voice code c(n) is constituted of imin and jmin as described above and outputted to the transmitter/receiver 13. Then, the voice code (n) is radio-modulated by the transmitter/receiver 13 and transmitted via the antenna 11.

Subsequently in S260, L is obtained from the voice code c(n) outputted in S250 and limiting key data $k_{lim}$ by the equation 10, and in the next S270, r is obtained from the voice code c(n) outputted in S250 and reverse key data $k_{rev}$ by the aforementioned equation 12.

Subsequently, in the next S280, the encoder determines whether or not the value of r is 0, and the process advances to S300 as it is when the value of r is 0 (S280: YES), but shifts to S290 to change the dividing key data $k_{idx}$ by the equation 13 when the value of r is not 0 (S280: NO), and then advances to S300.

Subsequently, it is determined in S300 based on the on/off state of a call switch (not shown) whether or not call ends, the process returns to S120 of FIG. 5 when the call does not end (S300: NO), or the operation of the encoder 9 is ended when the call ends (S300: YES).

Specifically, in the processing of FIGS. 5 and 6, the VQ target vector x(n) is successively inputted by S140 to S155, S180 to S250, the gain code gimin and waveform code yjmin forming the representative vector data y(n) most approximate to the VQ target vector x(n) are selected from the excitation waveform codebook 25, and the voice code c(n) is constituted of the numbers imin, jmin of the gain code gimin and waveform code yjmin and outputted.

Moreover, particularly in the processing of FIGS. 5 and 6, L of the equation 10 is obtained with respect to the previously outputted voice code in S260 before selecting the gain code gimin' and waveform code yjmin with respect to the current VQ target vector x(n) (S180 to S240). Additionally, when it is determined in S120, S160 that the value of L is 0, it is determined that the synthesis condition is established, the bit t of the text data to be combined with the voice code is read (S130), and the synthesis method described in the above <1> is performed by the changing based on the determination in S170.

Furthermore, r of the equation 12 is obtained with respect to the previously outputted voice code in S270 before selecting the gain code gimin and waveform code yjmin with respect to the current VQ target vector x(n). Additionally, when it is determined in S280 that the value of r is not 0, it is determined that the change condition is established, and in S290 the dividing key data $k_{idx}$ for use in the next S170 is changed in accordance with the change rule of the equation 13.

Therefore, according to the encoder 9 for performing the processing of FIGS. 5 and 6, the voice code by G.728 LD-CELP is secretly combined with the respective bits of the text data.

Additionally, in the encoder 9 of the present embodiment, the processing of S120, S160, and S260 corresponds to a synthesis condition determination processing, and the processing of S270 and S280 corresponds to a change condition determination processing.

On the other hand, as shown in FIG. 7, when the decoder 15 starts its operation, first in S310, the values of L and r are initialized/set to 1, and the value of n as the frame order label is initialized/set to 0.

Subsequently, in S320, the value of n is incremented by 1, and in the next S330, the n-th voice code c'(n) is inputted from the transmitter/receiver 13.

Moreover, in the next S340, i and j are extracted from the voice code c'(n) inputted in the above S330, and in the next S350, the gain code gi and waveform code yj corresponding to i and j are extracted from the excitation waveform codebook 41.

Furthermore, in the next S360, the digital voice signal s'(n) for one frame corresponding to the presently inputted voice code c'(n) is reproduced from the gain code gi and waveform code yj obtained in the above S350, and outputted to the voice output device 17.

Subsequently, it is determined in S370 whether the value of L is 0 or not, and when the value of L is not 0 (S370: NO), the process advances to S390 as it is, but when the value of L is 0 (S370: YES), the process shifts to S380. Subsequently, in this S380, the decoder uses j extracted from the voice code c'(n) in the above S340 to check $k_{idx}(j)$, further stores the value of $k_{idx}(j)$ as the text data bit, and then the process advances to S390. Additionally, the bits stored in this S380 are successively outputted to the display 19, and the display 19 displays characters reproduced from the bit series.

Subsequently, in S390, L is obtained from the voice code c'(n) inputted in the above S330 and limiting key data $k_{lim}$ by the aforementioned equation 10, and in the next S400, r is obtained from the voice code c'(n) inputted in the above S330 and reverse key data $k_{rev}$ by the aforementioned equation 12.

Furthermore, it is determined in the next S410 whether the value of r is 0 or not, and when the value of r is 0 (S410: YES), the process advances to S430 as it is, but when the value of r is not 0 (S410: NO), the process shifts to S420 to change the dividing key data $k_{idx}$ by the aforementioned equation 13, and subsequently advances to S430.

Subsequently, it is determined in S430 based on the on/off state of the call switch (not shown) whether or not the call ends, the process returns to S320 when the call does not end (S430: NO), or the operation of the decoder 15 is ended when the call ends (S430: YES).

Specifically, in the processing of FIG. 7, the voice codes c'(n) generated by the encoder 9 of the other telephone set 3 are successively inputted by S320 to S360, and voice is reproduced by the decoding of G.728 LD-CELP, but it can be determined in S370 whether L is 0 or not with respect to the previously inputted voice code during the input of the next voice code as the current voice code c'(n) by obtaining L of the equation 10 with respect to the already inputted voice code in S390. Subsequently, when it is determined in S370 that the value of L is 0 (i.e., when it is determined that L obtained with respect to the previously inputted voice code is 0), it is determined that the synthesis condition is established, the separation method described in the above <1> is performed by S380, and the text data bit is extracted from the currently inputted voice code c'(n).

Furthermore, in the processing of FIG. 7, r of the equation 12 is obtained with respect to the previously inputted voice code by S400 before the determination in S370 is performed. Additionally, when it is determined in S410 that the value of r is not 0, it is determined that the change condition is established, and the dividing key data $K_{idx}$ for use in S380 is changed in accordance with the change rule of the equation 13 in S420.

Therefore, according to the decoder 15 for performing the processing of, FIG. 7, the voice is reproduced from the voice code generated by the encoder 9, and the respective bits of the text data combined with the voice code can securely be extracted.

Additionally, in the decoder 15 of the present embodiment, the processing of S370 and S390 corresponds to the synthesis condition determination processing, and the processing of S400 and S410 corresponds to the change condition determination processing. Moreover, the processing of S380 corresponds to a separation processing, and the processing of S420 corresponds to a change processing.

Moreover, according to the telephone sets 1, 3 of the present embodiment provided with the aforementioned encoder 9 and decoder 15, the caller as the user can communicate both by voices and sentences.

"Experiment Result"

Additionally, it is important not to remarkably deteriorate the sound quality by the embedding so that the third party should not know the presence of the embedding.

With respect to the encoder 9 and decoder 15 of the present embodiment, the result of simulation performed by constituting an experiment system based on the algorithm of G.728 LD-CELP will be described hereinafter.

First, four types of voices shown in the aforementioned [Table 1] were used as experiment voices.

Moreover, the text data included in Request for Comments (RFC) as an Internet specification was used as the information to be embedded in the voice code.

Furthermore, the following was used as the dividing key data $k_{idx}$, reverse key data $k_{rev}$, and change key data $k_{xor}$. Additionally, in the following description, these three types of key data $k_{idx}$, $k_{rev}$, $k_{xor}$ are generically referred to as key K.

Moreover, in the following description, the values of the respective types of key data $k_{idx}$, $k_{lim}$, $k_{rev}$, $k_{xor}$ shown in {} are represented by hexadecimal numbers of 0 to F.

$k_{idx}$={6770DEF35BDD9F1CA21C05881A8CCA15}

$k_{rev}$={060}

$k_{xor}$={FFFFFFFFFFFFFFFFFFFFFFFFFFFFFFFF}

Here, in the present experiment, since the reverse key data $k_{rev}$ and change key data $k_{xor}$ are set as described above, all "0" and "1" in the dividing key data $k_{idx}$ are reversed at a probability of about ⅓ (see FIG. 4).

On the other hand, there is a Signal-to-quantization Noise Ratio (SNR) as a most basic objective sound quality evaluation measure. Additionally, as described in the aforementioned document 2 or the like, an SNR [dB] evaluation equation can be represented by the following equation 14 using input voice (input voice signal referred in the present embodiment) So(m) and quantization error Er(m).

$$SNR = 10\log_{10}\left\{\sum_m So^2(m) \Big/ \sum_m Er^2(m)\right\} \text{ [db]} \qquad \text{Equation 14}$$

Therefore, in the present experiment, a segmental SNR (SNRseg) constituted by improving SNR and enhancing the correspondence with subjective evaluation was used as an objective evaluation method. This SNRseg is defined by the following equation 15 as described in the aforementioned document 2 or the like. Additionally, in the equation 15, Nf denotes the frame number in a measurement section, and SNRf is an SNR in f frames. Moreover, in the present experiment, the length of one frame was set to 32 ms.

$$SNRseg = \frac{1}{Nf}\sum_{f=1}^{Nf} SNRf \text{ [db]} \qquad \text{Equation 15}$$

Moreover, in the present experiment, opinion evaluation by evaluator absolute determination (MOS: Mean Opinion Score) was used as the subjective evaluation method. Additionally, this opinion evaluation is also described in the aforementioned document 2 or the like.

Figure 8:
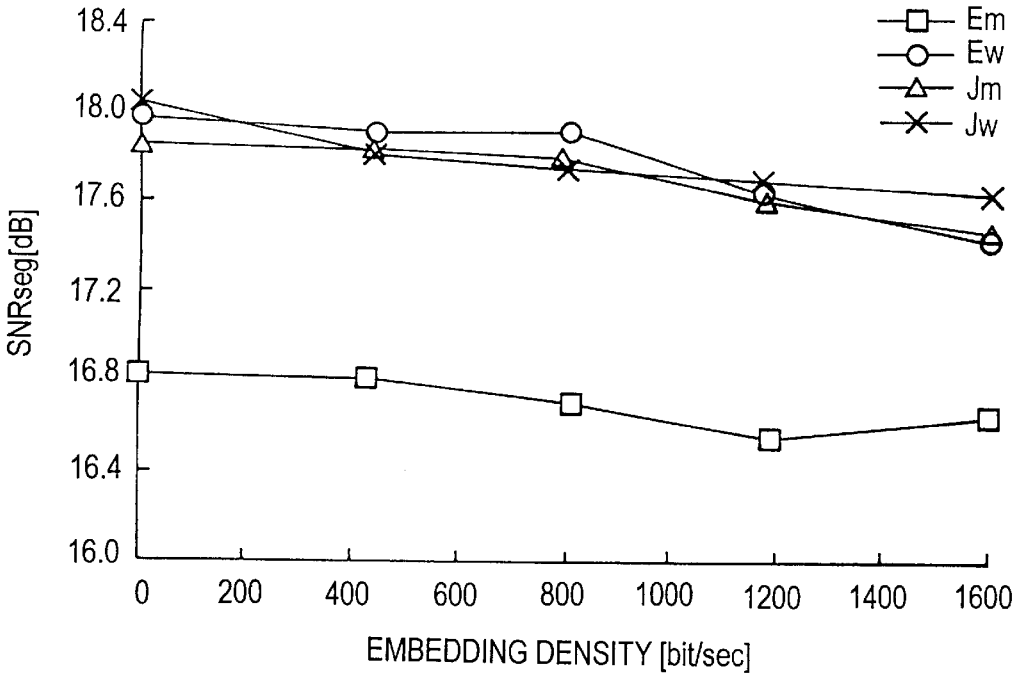
FIG. 8 is a graph of an experiment result showing a relation between embedding density and SNRseg.

Next, the result of the experiment using four types of voices of [Table 1] and the aforementioned key K is shown in FIG. 8.

FIG. 8 shows a relation between an embedding density with time and SNRseg with respect to the respective voices "Em", "Ew", "Jm", "Jw" of [Table 1]. Additionally, the following four types were used as the limiting key data $k_{lim}$.

$k_{lim}$ {044}, {004}, {020}, {000}

For example, for the embedding density with $k_{lim}$={020}, since only the 6-th bit from the lowermost bit-of the limiting key data $k_{lim}$ is "1 ", p6=0.3 is obtained from FIG. 4, and 1600×(1–0.3)=1120 [bit/s] is substantially estimated from the equation 11. Moreover, when the embedding density is 0 [bit/s], no embedding processing is performed.

As seen from the result of FIG. 8, even when a large number of embedding is performed, the deterioration amount of SNRseg by embedding is little. Therefore, it is considered that quantization strains are of the same degree with and without the embedding.

Moreover, the experiment described hereinafter was performed using $k_{lim}$={102} as the limiting key data $k_{lim}$. Additionally, since the embedding density is substantially p2=0.1, p9=0.5 from FIG. 4, 1600×(1–0.1)×(1–0.5)=720 [bits/s] is estimated from the equation 11.

Figure 9:
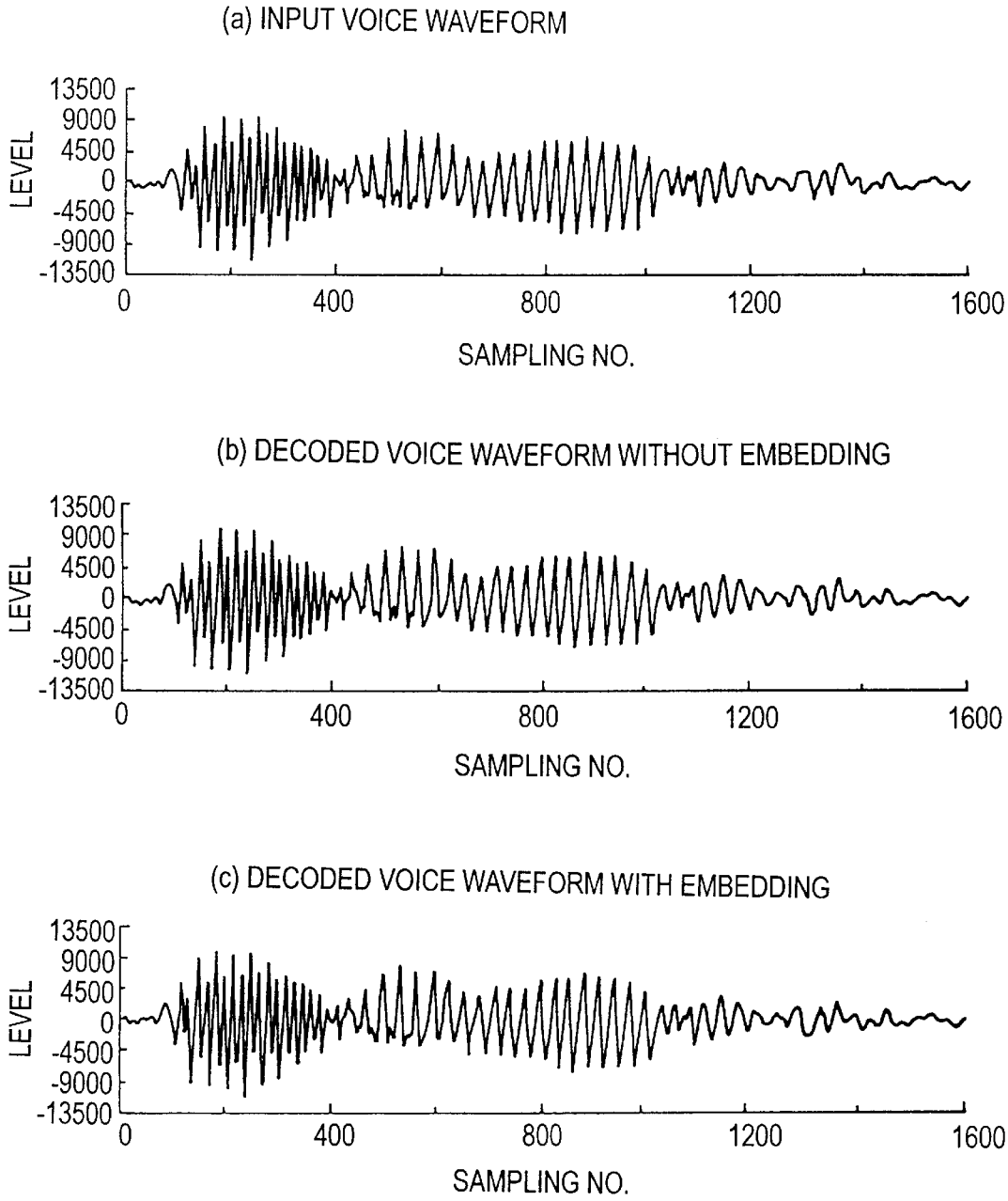
FIG. 9 is a diagram showing the observation result of the shape of a voice waveform.

First, the result obtained by extracting a part of reproduced voice waveform, and observing the shape of the waveform is shown in FIG. 9. Additionally, FIG. 9(*a*) shows an input voice waveform, FIG. 9(*b*) shows a reproduced voice waveform without embedding, and FIG. 9(c) shows the reproduced voice waveform subjected to a large amount of embedding. Moreover, the waveform shows the part of pronunciation "think" in "Em" of [Table 1] in a voice section for about 0.2 second.

As seen from the respective waveforms of FIG. 9, a large waveform strain regarded as the influence by the embedding of the other data in the voice code was not observed.

Moreover, the voice code (voice data) usually transmitted using the method of the present embodiment is only the voice code subjected to the embedding. Therefore, even if the voice code is illegally robbed by the third party, the comparison with the waveform subjected to no embedding cannot be performed, and it is therefore regarded as difficult to find the presence/absence of embedding from the waveform shape of the reproduced voice.

Additionally, when any change appears in the bit characteristic of the voice code as a result of embedding, the third party possibly finds a clue to decipher.

Figure 10:
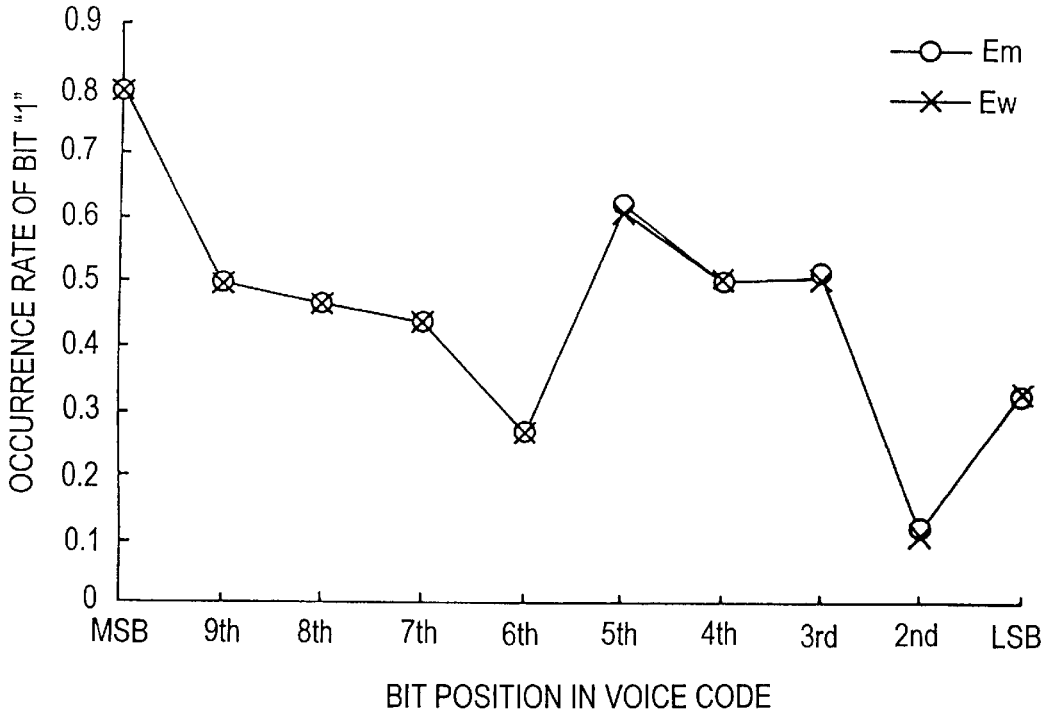
FIG. 10 is a graph showing the occurrence rate of bit "1" in the respective bit positions of the voice code subjected to embedding.

Then, when the bit characteristic of the voice code subjected to the embedding was checked similarly to FIG. 4, the result was obtained as shown in FIG. 10.

The comparison of FIG. 10 with FIG. 4 shows that no large influence by the embedding occurs. Therefore, it is regarded as remarkably difficult for the third party to know the presence of embedding from the change of the bit characteristic of the voice code.

Subsequently, the possibility offending the embedding by an acoustic sound quality difference was studied.

In the present experiment, eight normal listeners in later twenties evaluated the respective reproduced voices in an objective manner and obtained the mean opinion score (MOS). Moreover, the reproduced voice subjected to no embedding and reproduced voice subjected to embedding were prepared with respect to the respective experiment voices of [Table 1] as evaluation voices, and experiment subjects performed the arbitrary number of evaluations by comparison. Therefore, if a difference is felt in the reproduced voice sound quality, a large difference must be generated in the evaluation value.

The experiment result is shown in the following [Table 2].

Mean Opinion Score

| VOICE | WITHOUT EMBEDDING | WITH EMBEDDING | EMBEDDING DENSITY (byte/s) |
|---|---|---|---|
| Jm | 3.14 | 2.86 | 89.9 |
| Jw | 3.57 | 3.57 | 87.9 |
| Em | 3.00 | 3.43 | 90.2 |
| Ew | 3.57 | 3.43 | 90.5 |
| Mean | 3.32 | 3.32 | 89.6 |

As seen apparently from [Table 2], the MOS of the reproduced voice subjected to no embedding is substantially the same as the MOS of the reproduced voice subjected to embedding.

Therefore, the sound quality of the reproduced voice subjected to embedding is of substantially the same degree as that of the reproduced voice subjected to no embedding, and it can be said that it is difficult to judge the presence/absence of embedding by listening.

Additionally, in [Table 2], the MOS indicates a value of about 3 supposedly on the ground that the experiment voice for use in the input feels slightly obscure as compared with a compact disk or the like. Moreover, the dispersions of the respective evaluation values are supposedly caused by random errors generated because the listeners cannot specify the voice subjected to the embedding.

From the aforementioned results, it can be said that it is remarkably difficult for the illegal third party who has neither original voice signal nor reproduced voice subjected to no embedding to specify the voice code with the other data embedded therein from a large number of voice codes and to decipher the embedded information.

Modification Example 1

Additionally, when the encoder 9 of the aforementioned embodiment always performs the processing of S130 of FIG. 5 prior to S140 without performing the processing of S120 and S160 of FIG. 5 or the processing of S260 of FIG. 6, the text data bits can be embedded in all the voice codes c(n).

Moreover, in this case, the decoder 15 may always perform the processing of S380 after S360 without performing the processing of S370 and S390 of FIG. 7.

Modified Example 2

Furthermore, when the dividing key data $k_{idx}$ is not changed in the aforementioned embodiment, or in the modified example 1, the encoder 9 may fail to perform the processing of S270 to S290 of FIG. 6, and the decoder 15 may fail to perform the processing of S400 to S420 of FIG. 7.

Others

The encoder 9 and decoder 15 of the aforementioned embodiment perform the encoding/decoding of the voice by G.728 LD-CELP, but the same method can be applied to the other encoding system using the vector quantization.

Moreover, in the aforementioned embodiment, since the present invention is applied to the telephone set, the voice code c generated by the encoder 9 is immediately radio-modulated and transmitted, but the voice code c may be stored in a predetermined recording medium. Furthermore, in this case, the voice codes c may successively be read from the recording medium, and decoded by the decoder 15.

Furthermore, the encoder 9 and decoder 15 of the aforementioned embodiment encode/decode the voice, but may encode/decode the vibration wave other than the voice such as an analog signal outputted from a sensor, a measuring instrument, and the like. Specifically, the digital signal obtained by sampling the aforementioned analog signal every predetermined time may be inputted to the encoder 9 instead of the input voice signal s.

Moreover, in this case, when the vibration wave of the analog signal outputted from the sensor or the measuring instrument is encoded, the other data such as text data can be combined, or the other data can be separated and extracted from the encoded signal.

What is claimed is:

1. A method for encoding a vibration wave by vector quantization in which vector data indicating a waveform of a vibration wave for a predetermined time is successively inputted, representative vector data most approximate to said inputted vector data is selected from a codebook for storing a plurality of representative vector data successively numbered beforehand every time said vector data is inputted, and binary data indicating the number of the selected representative vector data is outputted as the code indicating said inputted vector data, the vibration wave encoding method comprising steps of:

storing division instruction information indicating that each representative vector data stored in said codebook belongs to either a first group or a second group in predetermined memory means; and reading other binary data to be combined with said vibration wave before selecting the representative vector data most approximate to the currently inputted vector data, selecting the representative vector data most approximate to the currently inputted vector data only from the representative vector data belonging to said first group as indicated by the division instruction information stored in said memory means in the representative vector data stored in said codebook when the read binary data is "0", or selecting the representative vector data most approximate to the currently inputted vector data only from the representative vector data belonging to said second group as indicated by the division instruction information stored in said memory means in the representative vector data stored in said codebook when said read binary data is "1", so that the code indicating the currently inputted vector data is combined with said read binary data.

2. The vibration wave encoding method according to claim 1, further comprising steps of:

performing a change condition determination processing of determining, with respect to said code previously outputted, whether or not a bit series of the code has a predetermined arrangement pattern before selecting the representative vector data most approximate to the currently inputted vector data, and changing the division instruction information to be stored in said memory means in accordance with a predetermined change rule when an affirmative determination is made by the change condition determination processing.

3. A vibration wave decoding method for successively inputting the code generated by the encoding method according to claim 1, extracting the representative vector data of the number indicated by the code from the codebook every time said code is inputted, and reproducing the waveform corresponding to the currently inputted code from the extracted representative vector data, to restore said vibration wave.

4. A vibration wave decoding method for successively inputting the code generated by the encoding method according to claim 2, extracting the representative vector data of the number indicated by the code from the codebook every time said code is inputted, and reproducing the waveform corresponding to the currently inputted code from the extracted representative vector data, to restore said vibration wave, the vibration wave decoding method comprising steps of:

storing the division instruction information indicating that each representative vector data stored in said codebook belongs to either a first group or a second group in predetermined memory means;

determining that the code is combined with the binary data "0" when the number indicated by the currently inputted code is the number of the representative vector data belonging to said first group as indicated by the division instruction information stored in said memory means in the representative vector data stored in said codebook, determining that the code is combined with the binary data "1 " when the number indicated by the currently inputted code is the number of the representative vector data belonging to said second group as indicated by the division instruction information stored in said memory means in the representative vector data stored in said codebook, and performing a separation processing to separate said other binary data from the currently inputted code; and performing the change condition determination processing with respect to said code previously inputted before performing said separation processing with respect to said code currently inputted, and performing a change processing to change the division instruction information to be stored in said memory means in accordance with the change rule when an affirmative determination is made by the change condition determination processing vibration wave, the vibration wave decoding method comprising steps of:

storing the division instruction information indicating that each representative vector data stored in said codebook belongs to either a first group or a second group in predetermined memory means; and determining that the code is combined with the binary data "0" when the number indicated by the currently inputted code is the number of the representative vector data belonging to said first group as indicated by the division instruction information stored in said memory means in the representative vector data, stored in said codebook, determining that the code is combined with the binary data "1 " when the number indicated by the currently inputted code is the number of the representative vector data belonging to said second group as indicated by the division instruction information stored in said memory means in the representative vector data stored in said codebook, and separating said other binary data from the currently inputted code.

5. A method for encoding a vibration wave by vector quantization in which vector data indicating a waveform of a vibration wave for a predetermined time is successively inputted, representative vector data most approximate to said inputted vector data is selected from a codebook for storing a plurality of representative vector data successively numbered beforehand every time said vector data is inputted, and binary data indicating the number of the selected representative vector data is outputted as the code indicating said inputted vector data, the vibration wave encoding method comprising steps of:

storing division instruction information indicating that each representative vector data stored in said codebook belongs to either a first group or a second group in predetermined memory means; and performing a synthesis condition determination processing of determining, with respect to said code previously outputted, whether or not a bit series of the code has a predetermined arrangement pattern before selecting the representative vector data most approximate to the currently inputted vector data; and reading other binary data to be combined with said vibration wave when an affirmative determination is made by the synthesis condition determination processing, selecting the representative vector data most approximate to the currently inputted vector data only from the representative vector data belonging to said first group as indicated by the division instruction information stored in said memory means in the representative vector data stored in said codebook when the read binary data is "0", or selecting the representative vector data most approximate to the currently inputted vector data only from the representative vector data belonging to said second group as indicated by the division instruction information stored in said memory means in the representative vector data stored in said codebook when said read binary data is "1", so that said read binary data is combined with the code indicating the currently inputted vector data.

6. The vibration wave encoding method according to claim 5, further comprising steps of:

performing a change condition determination processing of determining, with respect to said code previously outputted, whether or not the bit series of the code has the predetermined arrangement pattern before selecting the representative vector data most approximate to the currently inputted vector data, and changing the division instruction information to be stored in said memory means in accordance with a predetermined change rule when the affirmative determination is made by the change condition determination processing.

7. A vibration wave decoding method for successively inputting the code generated by the encoding method according to claim 6 extracting the representative vector data of the number indicated by the code from the codebook every time said code is inputted, and reproducing the waveform corresponding to the currently inputted code from the extracted representative vector data, to restore said vibration wave, the vibration wave decoding method comprising steps of:

storing the division instruction information indicating that each representative vector data stored in said codebook belongs to either a first group or a second group in predetermined memory means;

performing the synthesis condition determination processing with respect to said code previously inputted when said code is inputted;

when an affirmative determination is made by the synthesis condition determination processing, determining, that the code is combined with the binary data "0" when the number indicated by the currently inputted code is the number of the representative vector data belonging to said first group as indicated by the division instruction information stored in said memory means in the representative vector data stored in said codebook, determining that the code is combined with the binary data "1" when the number indicated by the currently inputted code is the number of the representative vector data belonging to said second group as indicated by the division instruction information stored in said memory means in the representative vector data stored in said codebook, and separating said other binary data, from the currently inputted code; and performing the change condition determination processing with respect to said code previously inputted before performing said synthesis condition determination processing, and changing the division instruction information to be stored in said memory means in accordance with the change rule when the affirmative determination is made by the change condition determination processing.

8. A vibration wave decoding method for successively inputting the code generated by the encoding method according to claim 5, extracting the representative vector data of the number indicated by the code from the codebook every time said code is inputted, and reproducing the waveform corresponding to the currently inputted code from the extracted representative vector data, to restore said vibration wave, the vibration wave decoding method comprising steps of:

storing the division instruction information indicating that each representative vector data stored in said codebook belongs to either a first group or a second group in predetermined memory means;

performing the synthesis condition determination processing with respect to said code previously inputted when said code is inputted; and when an affirmative determination is made by the synthesis condition determination processing, determining that the code is combined with the binary data. "0" when the number indicated by the currently inputted code is the number of the representative vector data belonging to said first group as indicated by the division instruction information stored in said memory means in the representative vector data stored in said codebook, determining that the code is combined with the binary data "1" when the number indicated by the currently inputted code is the number of the representative vector data belonging to said second group as indicated by the division instruction information stored in said memory means in the representative vector data stored in said codebook, and separating said other binary data from the currently inputted code.

* * * * *